US006028567A

United States Patent [19]

Lahti

[11] Patent Number: 6,028,567

[45] Date of Patent: Feb. 22, 2000

[54] ANTENNA FOR A MOBILE STATION OPERATING IN TWO FREQUENCY RANGES

[75] Inventor: Saku Lahti, Tampere, Finland

[73] Assignee: Nokia Mobile Phones, Ltd., Espoo, Finland

[21] Appl. No.: 09/207,880

[22] Filed: Dec. 8, 1998

[30] Foreign Application Priority Data

Dec. 10, 1997 [FI] Finland ..... 974481 U

[51] Int. Cl.[7] ..... H01Q 1/36; H01Q 1/24; H01Q 9/16

[52] U.S. Cl. ..... 343/895; 343/702; 343/806

[58] Field of Search ..... 343/895, 700 MS, 343/702, 806

[56] References Cited

U.S. PATENT DOCUMENTS

| | | | |
|---|---|---|---|
| 4,860,020 | 8/1989 | Wong et al. | 343/828 |
| 4,998,078 | 3/1991 | Hulkko | 333/109 |
| 5,220,335 | 6/1993 | Huang | 343/700 MS |
| 5,223,849 | 6/1993 | Kasevich et al. | 343/895 |
| 5,276,920 | 1/1994 | Kuisma | 455/101 |
| 5,341,149 | 8/1994 | Valimaa et al. | 343/895 |
| 5,561,439 | 10/1996 | Moilanen | 343/846 |
| 5,608,413 | 3/1997 | Macdonald | 343/700 MS |
| 5,627,550 | 5/1997 | Sanad | 343/700 MS |
| 5,657,028 | 8/1997 | Sanad | 343/700 MS |
| 5,680,144 | 10/1997 | Sanad | 343/700 MS |
| 5,828,342 | 10/1998 | Hayes et al. | 343/702 |

*Primary Examiner*—Don Wong
*Assistant Examiner*—Jennifer H. Malos
*Attorney, Agent, or Firm*—Perman & Green, LLP

[57] ABSTRACT

The invention comprises an antenna structure particularly suitable for mobile stations operating on two frequency ranges. As a supporting component and also as component determining the electrical characteristics the antenna includes a dielectric plate (21). On one surface of the dielectric plate there is a radiating element (22) with a meander form, and on the opposite support of the dielectric plate there is a planar radiating element (23). The operation on two frequency ranges is based on the fact that the structure has two resonance frequencies, which are relatively far from each other. The strips are further relatively wide, due to which the antenna operates satisfactorily in different positions and in the vicinity of objects. The parasitic element can further have a gap operating as a separate radiator, whereby the antenna operates on three frequency ranges. The antenna according to the invention is flat, and therefore it can be fixed to the back wall of a mobile station, and the distance to the user's head is as large as possible.

8 Claims, 4 Drawing Sheets

ANTENNA FOR A MOBILE STATION OPERATING IN TWO FREQUENCY RANGES

The object of the invention is an antenna structure defined in the preamble of claim 1, particularly an antenna structure applicable in mobile stations operating on two frequency ranges.

The development of mobile station techniques have brought and will bring to the marketplace new, versatile models, in which new requirements are placed on the antennas: the antenna must for instance operate on two frequency ranges, such as the 900 MHz and 1.8 GHz ranges; the bandwidths must be relatively large; the radiation and reception characteristics must be rather good in different positions of the device and the antenna, as well as in different locations regarding external objects; and yet the antenna must be relatively small and compact.

FIG. 1 presents previously known antenna structures operating on two frequency ranges.

1) Structures Based on a Helix

A double helix: Two helix elements 101 and 102 having different resonance frequencies are placed within each other, in an interleaved fashion or on top of each other. The elements have either a common or a separate feed.

A helix and a monopole: Within a helix element 103 there is placed a rod element 104 having a different resonance frequency. The elements have either a common or a separate feed.

Disadvantages of the structures based on helix elements are the relatively high manufacturing costs and clearly deteriorated characteristics, when the antenna is located or turned close to the frame of the device.

2) Microstrip Structures

A double strip: A radiating strip 105 is on the surface of a dielectric plate, and within it is another strip 106 having a different resonance frequency. The feed is made for instance to the strip 105, and the strip 106 is parasitic. The ground plane 107 is on the other surface 108 of the plate.

A strip and a transmission line: On the surface of a dielectric plate 111 there is a strip 109, and a strip 110, functioning as a part of a short-circuited transmission line. The transmission line is dimensioned so that it radiates at one of the two desired frequencies.

A disadvantage of the presented and other corresponding microstrip structures is their relatively narrow bandwidth. An improvement can be achieved by adding parasitic elements to the structure, but then the structure's relatively large size will be a disadvantage.

3) Chip Structures

Within a dielectric monolithic body 114 there are two conductors 112 and 113 with a meander form, which radiate at different frequencies. The disadvantage of these structures is the relatively narrow bandwidth.

In addition to the above presented structures there are double band antennas based on a half-wave dipole. Their disadvantage is a relatively large size.

The object of the invention is to reduce the above mentioned disadvantages relating to prior art. An antenna according to the invention is characterised in what is presented in the independent claim. Some preferred embodiments of the invention are presented in the dependent claims.

The basic idea of the invention is as follows: on one side of a small dielectric plate, such as a printed circuit board, there is a regularly or almost regularly repeating conductor pattern, which at one end is connected to a conductor for reception and the antenna feed. On the opposite side of the plate, or within it, there is a parasitically coupled conducting area which is formed so that the structure has two resonance frequencies relatively far away from each other.

The advantage of the invention is that the bandwidths at each operating range will be wider than in prior known structures. This is important, particularly when the device is used in different positions, and when the pass-bands slightly shift, due to i.a. a shifted position. A further advantage of the invention is that when the antenna is short and flat, it is on one hand possible to turn it into a protected position close to the frame of the device, and on the other hand that its electrical characteristics then remain adequate, because the distance to the device frame is kept relatively large. A further advantage of the invention is that due to the flat form of the antenna it can be placed at the back wall in mobile phones, whereby the power (SAR) absorbed into the user's head will be as low as possible. A further advantage of the invention is that the costs of the antenna are relatively low due to the simple structure.

The invention is described in detail below. In the description reference is made to the enclosed drawings, in which FIG. 1 shows dual band antennas according to prior art;

Figure 1A:
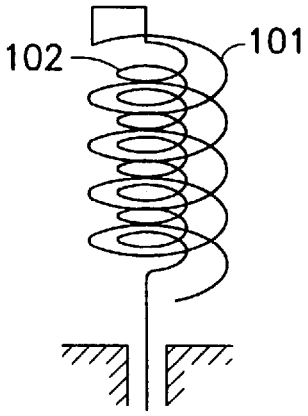
FIG. 1a PRIOR ART
Figure 1B:
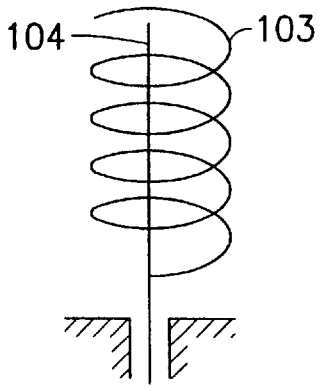
FIG. 1b PRIOR ART
Figure 1C:
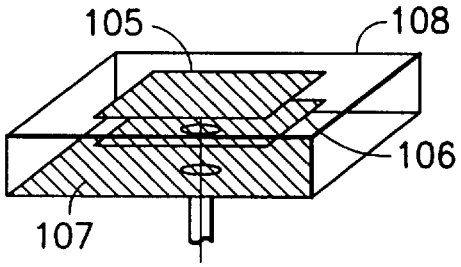
FIG. 1c PRIOR ART
Figure 1D:
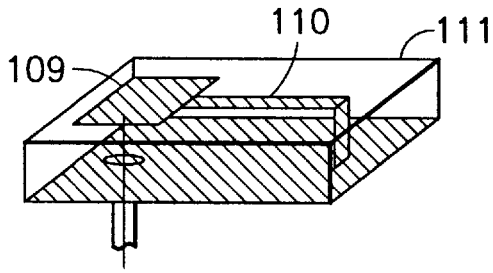
FIG. 1d PRIOR ART
Figure 1E:
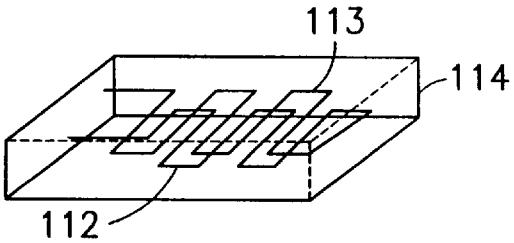
FIG. 1e PRIOR ART
Figure 2:
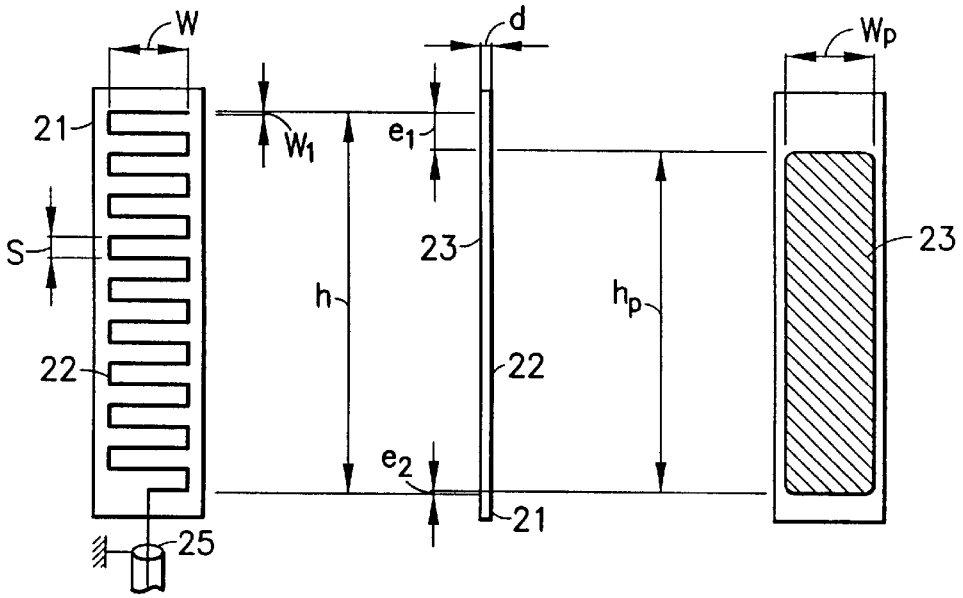
FIG. 2 shows a typical antenna according to the invention.

The structures of FIG. 1 were already described above in connection with the description of prior art. In FIG. 2 there is a structure according to the invention, which includes a dielectric plate 21, a radiating element 22 connected to the feed line 25 of the antenna, and a radiating parasitic element 23. In this example the dielectric plate is the dielectric layer of the printed circuit board. The element 22 is a rectangular conductor pattern of the meander type, which is formed on the other side of the plate 21, for instance by etching. In this connection meander means a line without branches and where a certain basic form or its modification, or different basic forms, are repeated in sequence in the same direction. Examples of the meander pattern are shown in FIG. 5. Below the element 22 is called a meander element. A parasitic element means a conductor which is galvanically isolated from the other conductors of the system, but which has an electromagnetic coupling to them. In this example a parasitic element 23 is a conductor area formed by etching on the surface, which is opposite regarding the meander element, and which is electromagnetically coupled to the meander element. The symbols affecting the characteristics of the antenna are also marked in FIG. 2: the thickness d of the dielectric layer, the height h of the meander element 22, the width w of the meander element, the height s of the repeating pattern in the meander element, the width $w_1$ of the conductor of the meander element, the height $h_p$ of the parasitic element 23, the width $w_p$ of the parasitic element, the height difference $e_1+e_2$ of the meander and parasitic elements, of which $e_1$ is at the upper end of the structure and $e_2$ at the bottom end. The height direction means here and particularly in the claims the direction of the largest dimension h of the meander element.

The structure of the FIG. 2 has two resonance frequencies, of which the lower is determined mainly by the meander element 22, and the upper mainly by the parasitic element 23. Naturally the elements interact and thus have an effect on both resonance frequencies. The structure is characterised in that the resonance frequencies are relatively far from each other; one can be arranged for instance in the frequency range used by the GSM network, and the other in the frequency range used by a PCN network or satellite telephones. The structure is particularly characterised in that the bandwidths both in the upper and the lower operating range are relatively large. The planar parasitic element causes namely a wide upper band and also acts on the lower band in a way which makes it wider. The bandwidths can be tuned by the dimensioning. When for instance the upper band is desired to be as wide as possible, then the parasitic element must be dimensioned as a wide one, and it must be located downwards, so that the dimension $e_1$ is relatively large. Wider bandwidths can also be obtained, without changing the resonance frequencies, by making the meander pattern with wider spaces, or by increasing the dimension s, and by at the same time increasing the heights h and $h_p$ of the radiating elements. Thus there must be a compromise between the bandwidths and the antenna size. The characteristics of the antenna are affected by the antenna dimensions and also by the matter between the meander and the parasitic elements: when the dielectric constant of the dielectric plate increases the upper resonance frequency decreases.

The band characteristics of an antenna are often examined by measuring its return loss $A_r$ as a function of the frequency. The return loss means the ratio between the energy supplied to the antenna and the energy returning from it. It is the absolute value of the inverse of the square of the reflection coefficient or the parameter $s_{11}$. The higher the return loss the larger part of the energy supplied to the antenna will be radiated into the environment, or the better the antenna operates. In an ideal case the return loss is thus infinite. When the return loss is 1, or 0 dB, the antenna will not radiate at all; all energy fed into it will return to the feeding source. The reception characteristics of the antenna follow the transmission characteristics: the more effectively the antenna transmits on a certain frequency and into a certain direction, the more effectively it also will receive on said frequency from said direction. The bandwidth of the antenna can be defined in different ways: it can mean the difference between those frequencies at which the return loss has decreased 3 dB from its best value or maximum value. Often the bandwidth is regarded as the difference between those frequencies at which the value of the return loss is 10 dB or 10. This corresponds to the value 2 of the standing wave ratio SWR.

Figure 3:
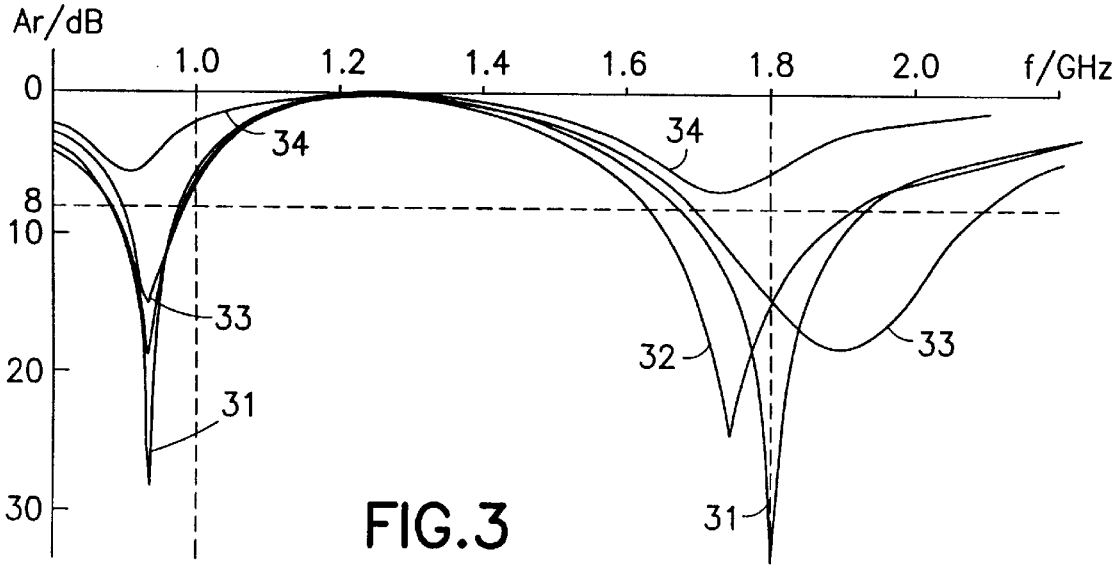
FIG. 3 shows the band characteristics of the antenna according to the invention.
Figure 4A:
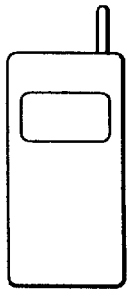
FIG. 4 shows an antenna mounted in a mobile station in different situations.
Figure 4B:
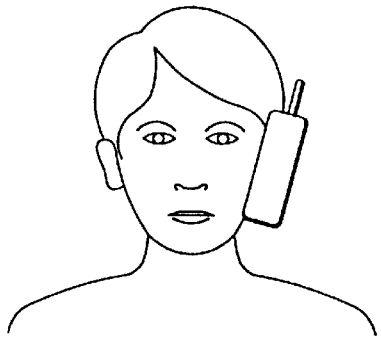
Figure 4C:
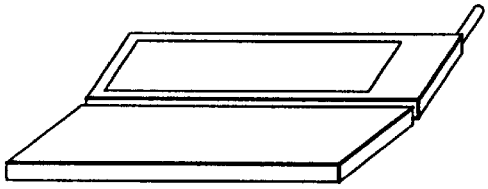
Figure 4D:
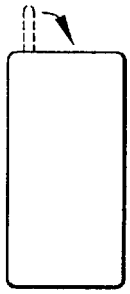

FIG. 3 shows an example of the variation of the return loss $A_r$ of an antenna according to the invention as a function of the frequency in different operating situations. The measurements results have been obtained with the following dimensions of the antenna: h=29.3 mm; w=5.4 mm; $h_p$=24.4 mm; $w_p$=5.4 mm; $e_1$=4.2 mm; $e_2$=0 mm; s=1.6 mm; $w_1$=0.5 mm; and d=0.76 mm. The dielectric constant of the printed circuit board is $\epsilon_r$=2.5. The measurement range in FIG. 3 is from 800 MHz to 2.2 GHz. The thin unbroken curve 31 corresponds to the situation of FIG. 4*a*: the antenna is out and pointing upwards, and there are no other objects in the vicinity. The broad unbroken curve 32 corresponds to the situation of FIG. 4*b*: a human head is now adjacent to the mobile station. The dotted line 33 corresponds to the situation of FIG. 4*c*: the antenna is out, but in an inclined position, such as in a multifunction mobile station during normal operation. The line 34 of dots and d ashes corresponds to the situation of FIG. 4*d*: the antenna is turned into a protected position, such as adjacent the frame of the mobile station. In the following the band limits are defined as frequencies, at which the return loss is 8 dB=6.3 (SWR≈2.3), except in the case of the turned antenna 34, where the bandwidth is defined on the basis of the −3 dB points. The curve 31 shows that when the mobile station is in a free space the lower range is about 900 to 975 MHz and the upper range about 1670 to 1940 MHz. The curve 32 shows that in the situation of a normal call the lower range is about 880 to 975 MHz, and the upper range about 1630 to 1920 MHz. The FIG. 33 shows that in the operational position of a multifunction mobile station the lower range is about 885 to 975 MHz and the upper range about 1690 to 2100 MHz. FIG. 34 shows that when the antenna is turned the lower range is about 845 to 955 MHz and the upper range about 1625 to 1890 MHz. It is observed that the position of the ranges and their widths depend on the position of the antenna and on the environment, but that in all cases the ranges cover the ranges used by the GSM and the PCN networks. When the antenna is in the turned position the mean return loss in the pass-band is of the order of 10 dB less than in the normal position. Then the transmit power is of course lower, but however, in most cases still sufficient.

Figure 5A:
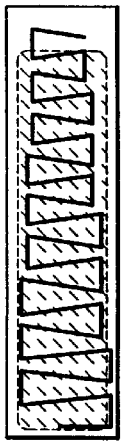
FIG. 5 shows some variations of the antenna according to the invention.
Figure 5B:
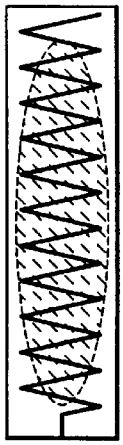
Figure 5C:
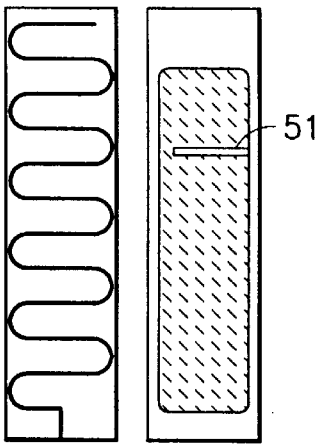
Figure 5D:
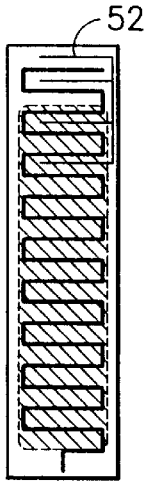

Above we described an antenna structure according to the invention and its characteristics. The invention is not limited to the above presented solutions. For instance, the number and the form of the radiating elements can vary. FIG. 5 shows examples of some possible variations. In FIG. 5*a* the meander element comprises straight sections as in FIG. 2, but the angles between the conductor sections differ from a straight angle. Further the width of the pattern increases in the downward direction. In FIG. 5*b* the meander element comprises straight sections, but they form a triangular wave pattern. In this example the parasitic element is elliptical instead of a rectangle. In FIG. 5*c* the meander element comprises circular arcs and straight lines. A gap 51 has been formed in the parasitic element, whereby the gap radiates on a third frequency range. An antenna like this can then be dimensioned to operate on the frequency ranges used by three systems. With the same intention FIG. 5*d* has a second parasitic element 52 on the same side of the printed circuit board as the feed conductor or the meander element. The material of the dielectric plate can also vary: in addition to the materials typically used in printed circuit boards it can be for instance polytetrafluoroethylene (PTFE) or another plastic. The radiating elements can be formed in the surface of the dielectric plate also in some other way than by etching, for instance by evaporation or by tooling the conductor surfaces of the printed circuit board: a conducting material can for instance be deposited on the surface of the plate by evaporation or by a screen printing method.

Figure 6:
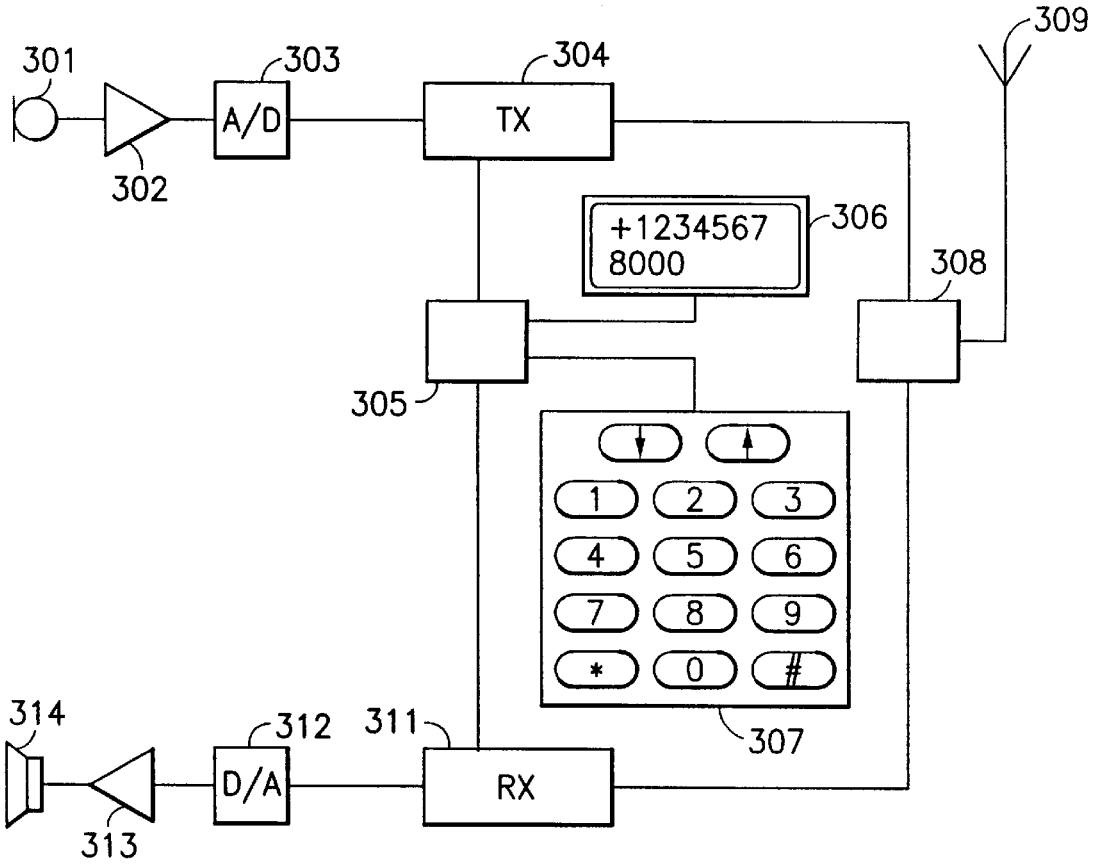
FIG. 6 shows a mobile communication means according to the invention.

FIG. 6 shows a block diagram of a digital mobile communication means according to an advantageous embodiment of the invention. The mobile communication means comprises a microphone 301, keyboard 307, display 306, earpiece 314, antenna duplexer or switch 308, and a control unit 305, which all are typical components of conventional mobile communication means. Further, the mobile communication means contains typical transmission and receiver blocks 304, 311. Transmission block 304 comprises functionality necessary for speech and channel coding, encryption, and modulation, and the necessary RF circuitry for amplification of the signal for transmission. Receiver block 311 comprises the necessary amplifier circuits and functionality necessary for demodulating and decryption of the signal, and removing channel and speech coding. The signal produced by the microphone 301 is amplified in the amplifier stage 302 and converted to digital form in the A/D converter 303, whereafter the signal is taken to the transmitter block 304. The transmitter block encodes the digital signal and produces the modulated and amplified RF-signal, whereafter the RF signal is taken to the antenna 309 via the duplexer or switch 308. The receiver block 311 demodulates the received signal and removes the encryption and channel coding. The resulting speech signal is converted to analog form in the D/A converter 312, the output signal of which is amplified in the amplifier stage 313, whereafter the amplified signal is taken to the earpiece 314. The control unit 305 controls the functions of the mobile communication means, reads the commands given by the user via the keypad 307 and displays messages to the user via the display 307. The mobile communication means further comprises an antenna structure 309. The antenna structure 309 preferably has a structure corresponding to some of the previously described inventive antenna structure or equivalent antenna structures.

In view of the foregoing description it will be evident to a person skilled in the art that various modifications may be made within the scope of the invention. While a preferred embodiment of the invention has been described in detail, it should be apparent that many modifications and variations thereto are possible, all of which fall within the true spirit and scope of the invention.

I claim:

1. An antenna which comprises a first element connected to its feed line and at least one parasitic element characterized in that said first element is a meander element, said parasitic element is a planar conductor area, and the supporting structure for the meander and parasitic elements is a dielectric plate, where said dielectric plate is the dielectric part of a printed circuit board, said meander element is a conductor area on the first surface of said printed circuit board and said parasitic element is a conductor area on the second, opposite surface of said printed circuit board, the antenna having a first operating frequency band and a second operating frequency band, the second operating frequency band being higher in frequency than the first operating frequency band, said parasitic element being adapted to widen at least the second operating frequency band.

2. A structure according to claim 1, characterised in that the width of the meander element in a first point in the height direction is different from its width in a second point in the height direction.

3. A structure according to claim 1, characterised in that the height of the parasitic element is less than the height of the meander element.

4. A structure according to claim 1, characterised in that the width of the parasitic element in a first point in the height direction is different from the width in a second point in the height direction.

5. A structure according to claim 1, characterised in that the parasitic element has a radiating gap.

6. A structure according to claim 1 which comprises a first parasitic element and a second parasitic element, characterised in that said second parasitic element is conductor area on the same side of the dielectric plate as the meander element.

7. A mobile station having an antenna structure which comprises a feed line, a first element connected to the feed line and at least one parasitic element, characterized in that said first element is a meander element, said parasitic element is a planar conductor area, and in that the antenna structure further comprises a supporting structure for the meander and parasitic elements, which supporting structure is a dielectric plate, where said dielectric plate is the dielectric part of a printed circuit board, said meander element is a conductor area on the first surface of said printed circuit board and said parasitic element is a conductor area on the second, opposite surface of said printed circuit board, the antenna having a first operating frequency band and a second operating frequency band, the second operating frequency band being higher in frequency than the first operating frequency band, said parasitic element being adapted to widen at least the second operating frequency band.

8. An antenna having a feed line, a first element connected to the feed line, and at least one parasitic element characterized in that said first element is a meander element, said parasitic element is a planar conductor area, and the width of the meander element at a first location in the height direction is different from its width at a second location in the height direction, and in that the antenna structure further comprises a supporting structure for the meander and parasitic elements, said supporting structure being a dielectric plate, where said dielectric plate is the dielectric part of a printed circuit board, said meander element is a conductor area on the first surface of said printed circuit board and said parasitic element is a conductor area on the second, opposite surface of said printed circuit board, the antenna having a first operating frequency band and a second operating frequency band, the second operating frequency band being higher in frequency than the first operating frequency band, said parasitic element being adapted to widen at least the second operating frequency band.

* * * * *